US010010893B2

(12) United States Patent
Ikushima

(10) Patent No.: US 10,010,893 B2
(45) Date of Patent: Jul. 3, 2018

(54) NOZZLE AND LIQUID MATERIAL DISCHARGE DEVICE PROVIDED WITH SAID NOZZLE

(71) Applicant: MUSASHI ENGINEERING, INC., Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 0 days.

(21) Appl. No.: 14/915,968

(22) PCT Filed: Sep. 8, 2014

(86) PCT No.: PCT/JP2014/073671
§ 371 (c)(1),
(2) Date: Mar. 2, 2016

(87) PCT Pub. No.: WO2015/034085
PCT Pub. Date: Mar. 12, 2015

(65) Prior Publication Data

US 2016/0199868 A1 Jul. 14, 2016

(30) Foreign Application Priority Data

Sep. 9, 2013 (JP) ..... 2013-185828

(51) Int. Cl.
*B05B 1/28* (2006.01)
*B05B 1/08* (2006.01)
(Continued)

(52) U.S. Cl.
CPC ..... *B05B 1/28* (2013.01); *B05B 1/083* (2013.01); *B05B 15/50* (2018.02); *B05C 11/1034* (2013.01); *B05C 5/02* (2013.01)

(58) Field of Classification Search
CPC ..... B05B 1/28; B05B 15/02; B05B 15/0275; B05B 15/0208; B05B 1/083; B05B 15/50; B05C 5/02; B05C 5/0225; B05C 11/1034
(Continued)

(56) References Cited

U.S. PATENT DOCUMENTS 5,129,579 A * 7/1992 Conte ..... B05B 17/06 239/104
6,661,504 B2 * 12/2003 Rakucewicz ..... G01N 21/8507 356/128
(Continued)

FOREIGN PATENT DOCUMENTS

JP 2002-79151 A 3/2002
JP 2005-246139 A 9/2005
(Continued)

OTHER PUBLICATIONS

International Search Report dated Dec. 2, 2014, issued in counterpart International Application No. PCT/JP2014/073671 (2 pages).
(Continued)

*Primary Examiner* — Christopher Kim
*Assistant Examiner* — Cody Lieuwen
(74) *Attorney, Agent, or Firm* — Westerman, Hattori, Daniels & Adrian, LLP

(57) ABSTRACT

A nozzle capable of removing a surplus liquid material, which is adhered to outer surfaces of the nozzle and which affects a discharge operation, without undergoing a special process, and a liquid material discharge device provided with the nozzle. The nozzle (1) includes a body (2) having a liquid inflow space, and a discharge tube (4) communicating with the liquid inflow space and extending downwards from the body (2). A liquid removing member (16) is disposed at a lower end of the body (2) in a state laterally surrounding the discharge tube (4), and the liquid removing
(Continued)

member (16) includes a groove-like space (15) that is formed between adjacent to of plural surrounding surfaces (10), and that generates capillary force acting in a direction laterally away from the discharge tube (4).

18 Claims, 11 Drawing Sheets

(51) Int. Cl.
*B05C 5/02* (2006.01)
*B05B 15/50* (2018.01)
*B05C 11/10* (2006.01)

(58) Field of Classification Search
USPC ..... 239/44–51.5, 110, 114, 119, 120, 121, 239/321, 322, 331, 74, 104, 106
See application file for complete search history.

(56) References Cited

U.S. PATENT DOCUMENTS 6,957,783 B1 * 10/2005 Fugere ..... B05C 5/0225 239/589
7,401,744 B2 * 7/2008 Holm ..... B05B 15/025 134/21
2005/0140747 A1 * 6/2005 Batterton ..... B41J 2/1433 347/71
2007/0007370 A1 * 1/2007 Roman ..... B05B 1/042 239/597
2008/0203185 A1 * 8/2008 Brown ..... A61L 9/127 239/44
2010/0016970 A1 1/2010 Kapitan et al.
2010/0156970 A1 * 6/2010 Ikushima ..... B05B 12/06 347/8

FOREIGN PATENT DOCUMENTS

JP 2006-212501 A 8/2006
JP 2007/516876 A 6/2007
JP 2007-216191 A 8/2007
JP 2008-229529 A 10/2008
JP 2010-62352 A 3/2010
JP 2010-188562 A 9/2010
WO 2008/146464 A1 12/2008

OTHER PUBLICATIONS

Translation of International Preliminary Report on Patentability, issued in counterpart International Application No. PCT/JP2014/073671 (4 pages).

* cited by examiner

[Fig. 1]
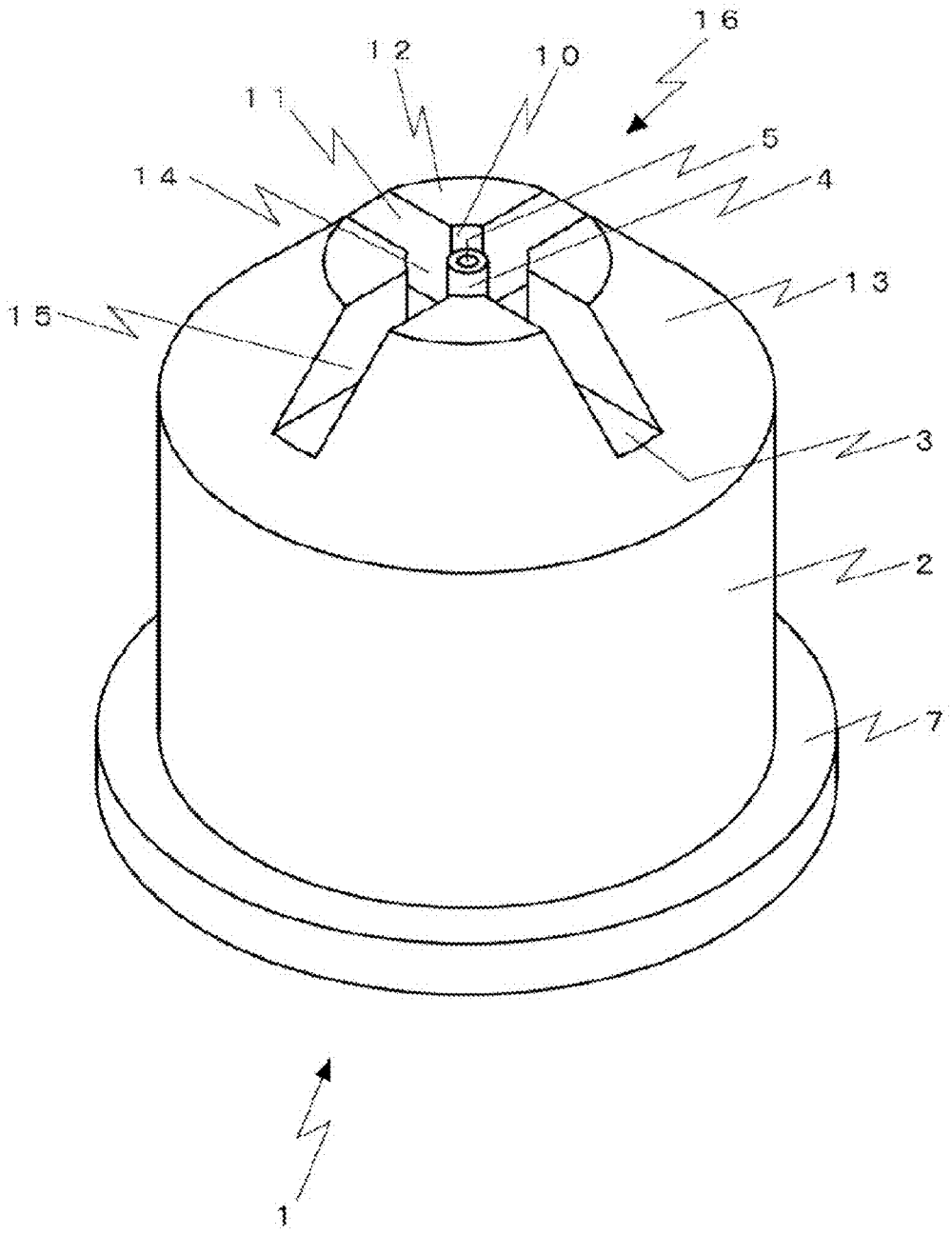

[Fig. 2]
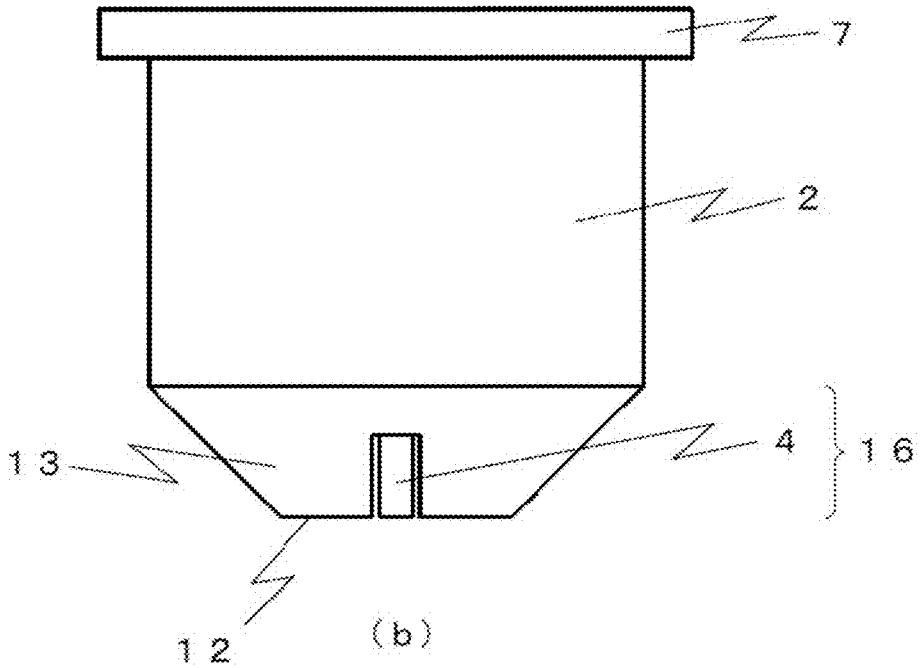
(b)
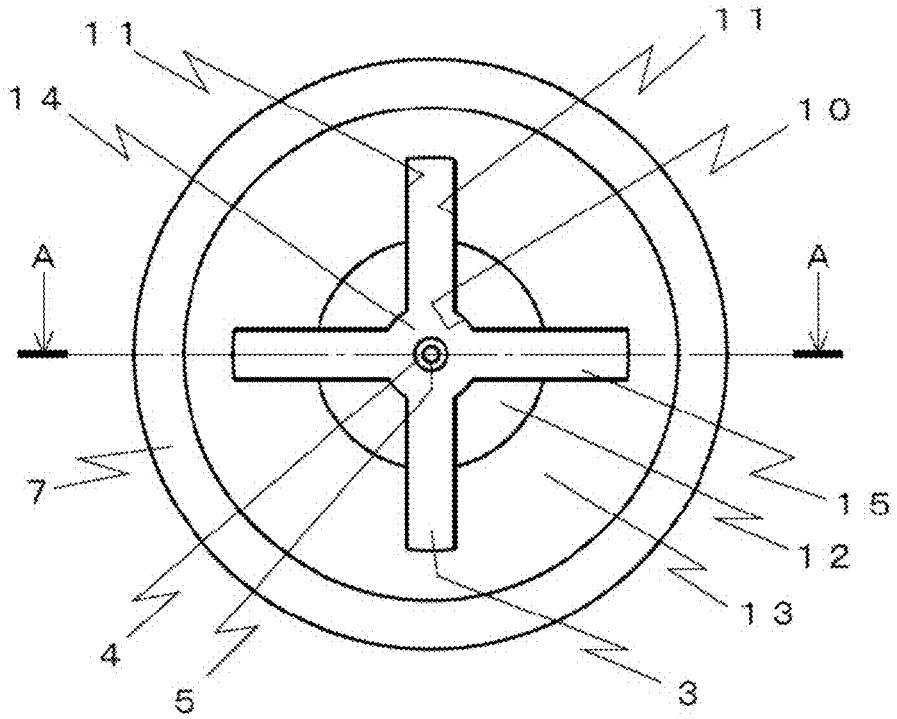
(a)

[Fig. 3]
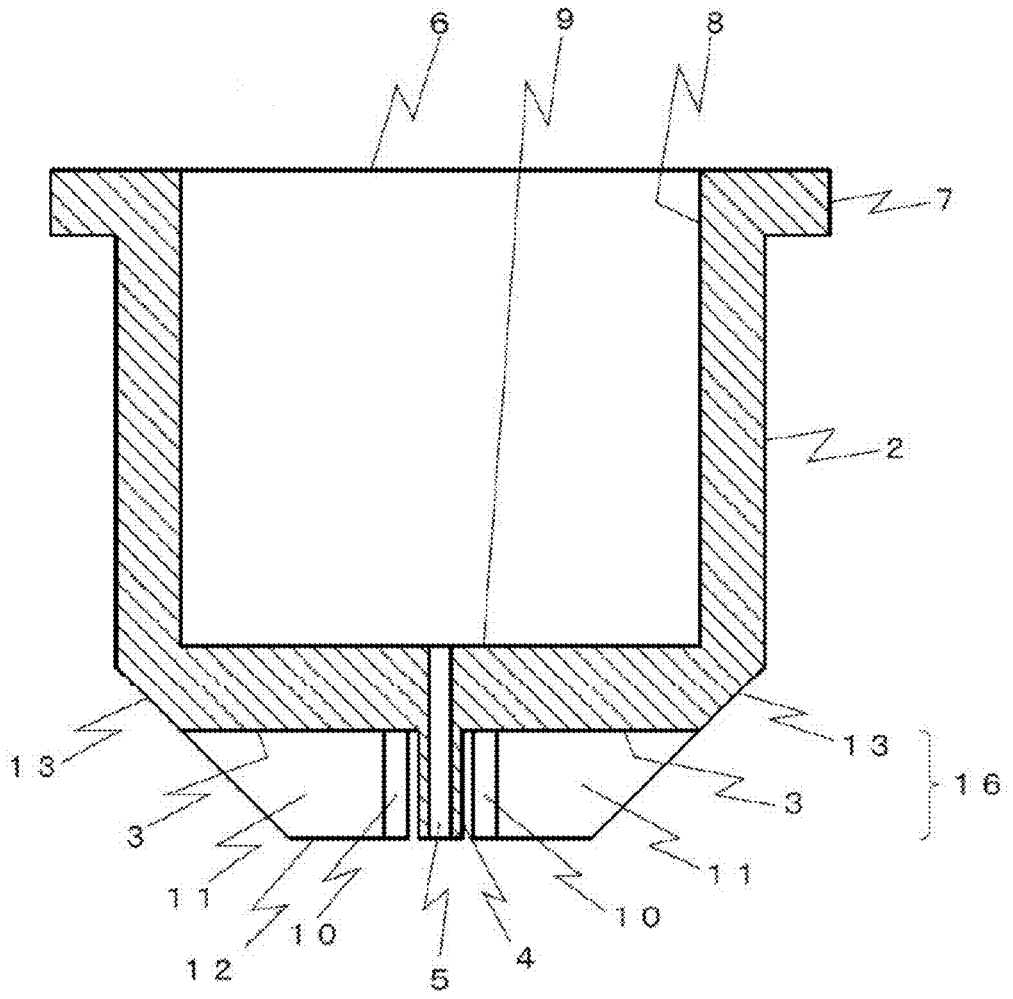

[Fig. 4]
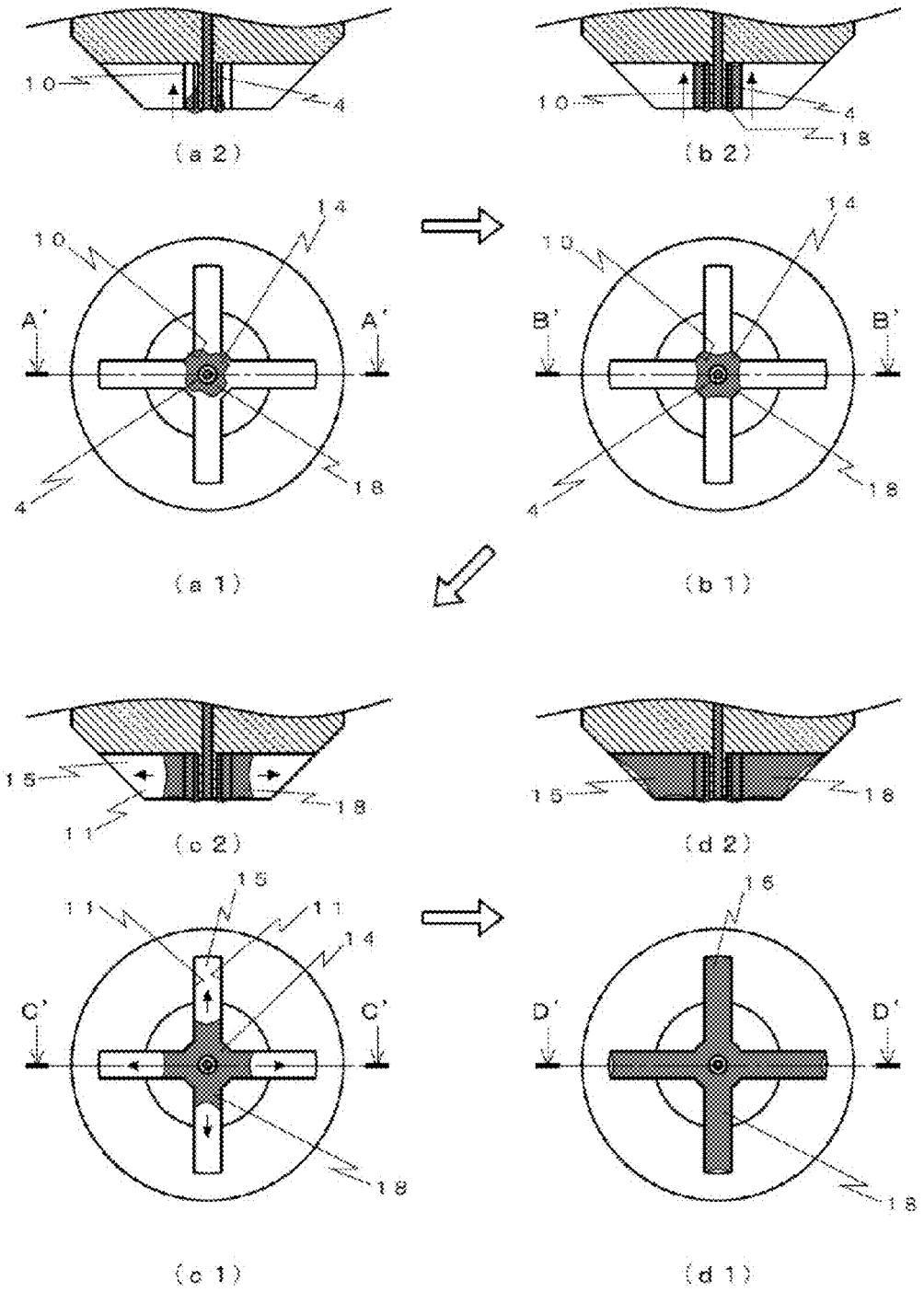

[Fig. 5]
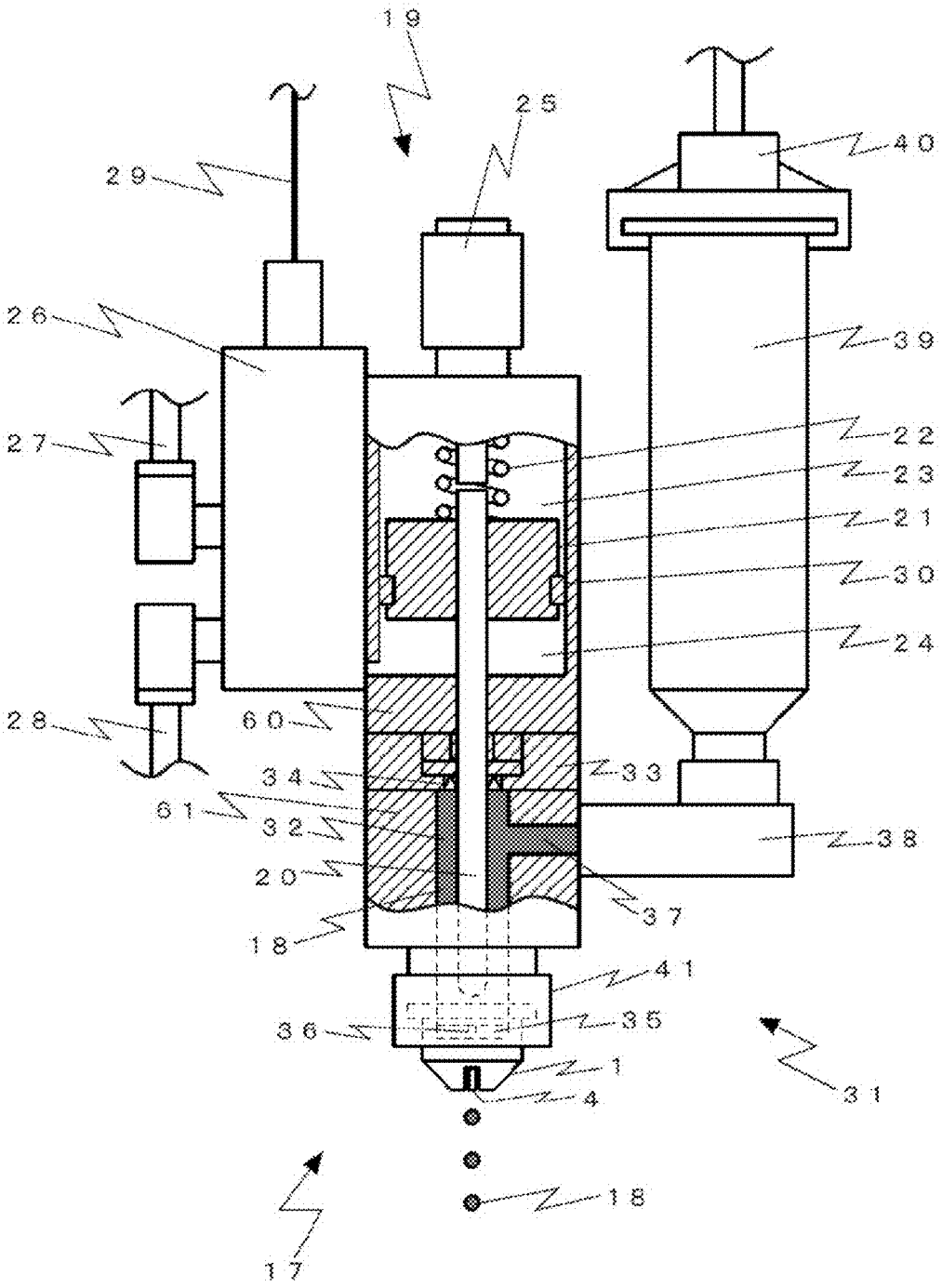

[Fig. 6]
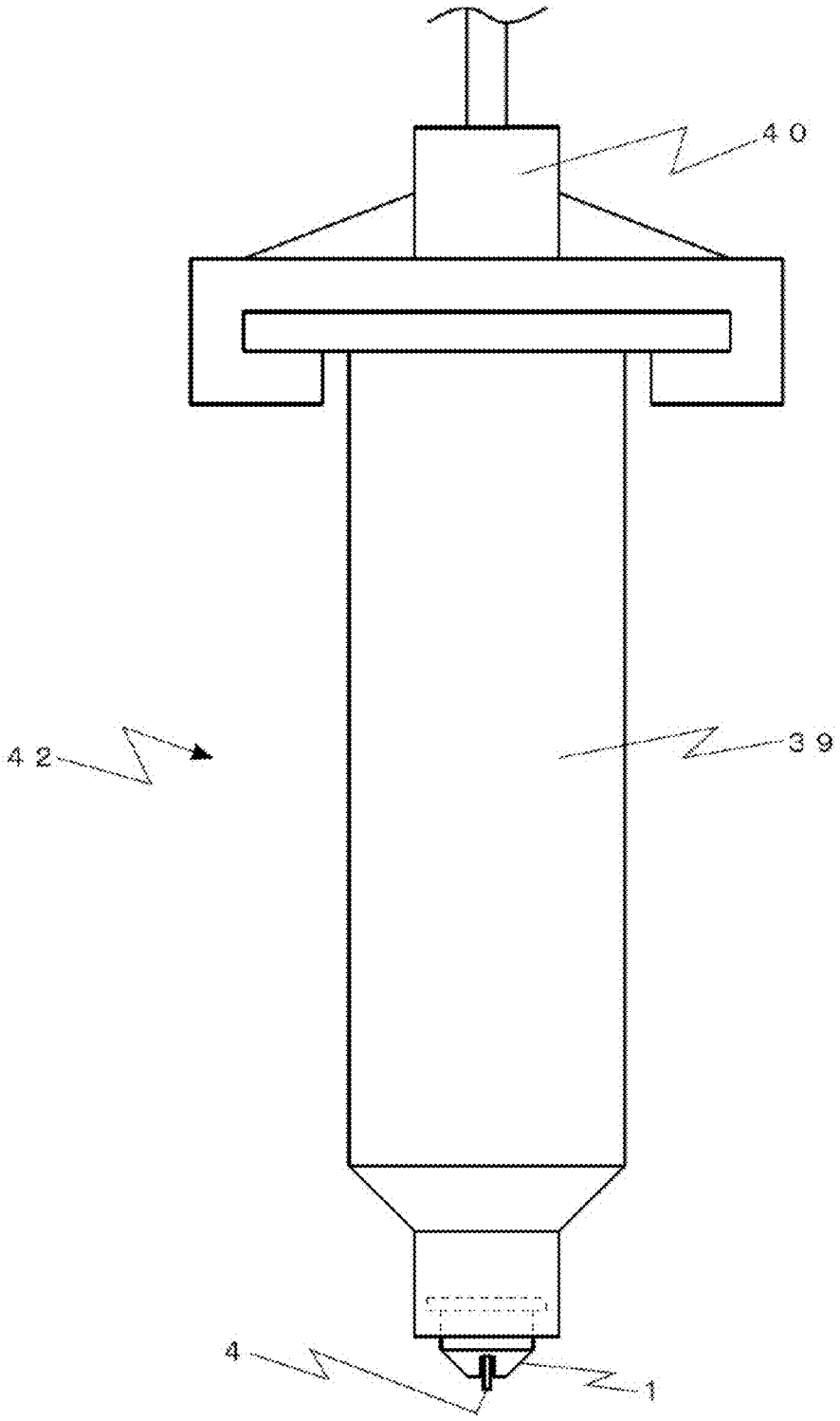

[Fig. 7]
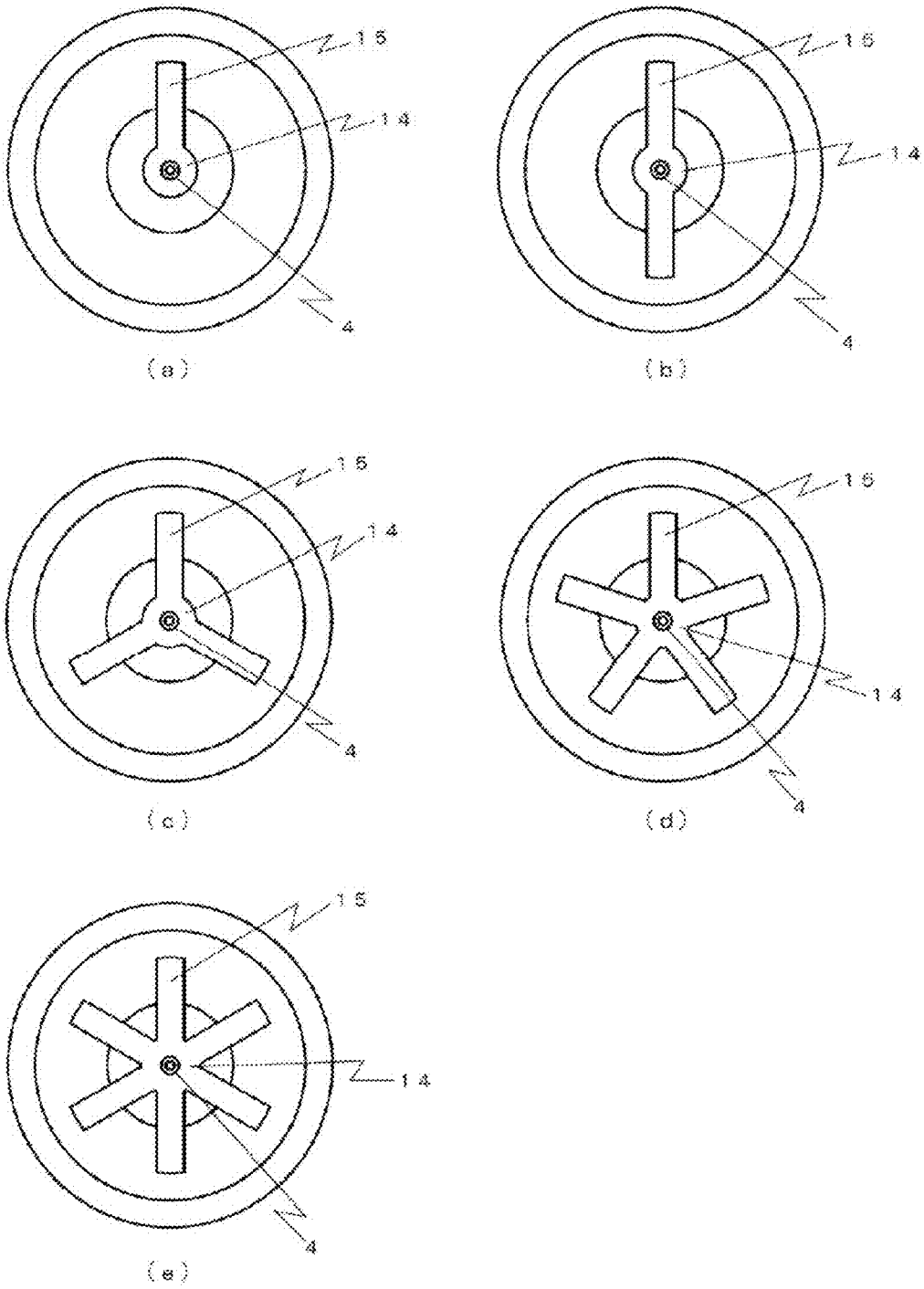

[Fig. 8]
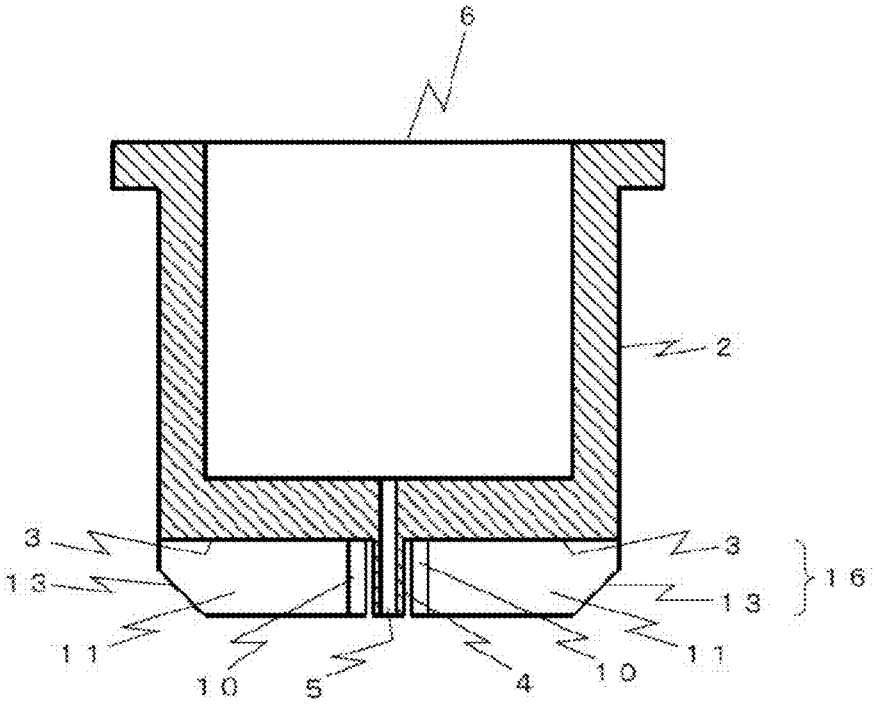
(b)
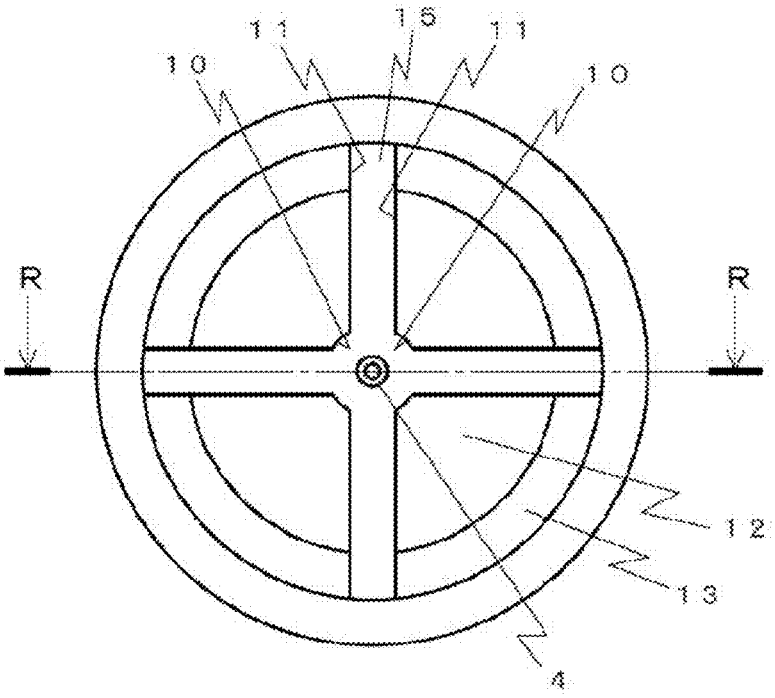
(a)

[Fig. 9]
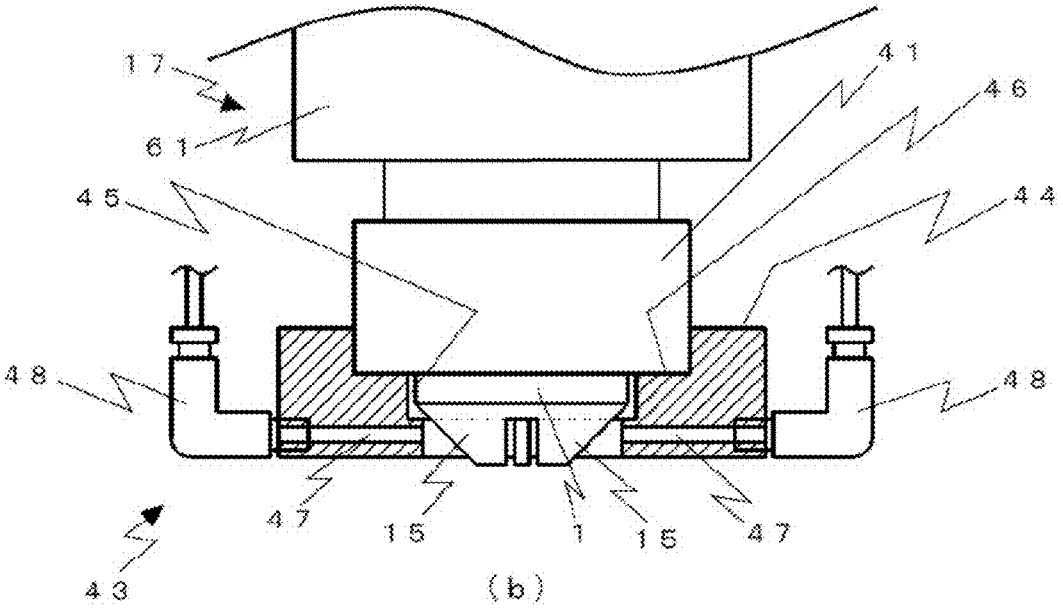
(b)
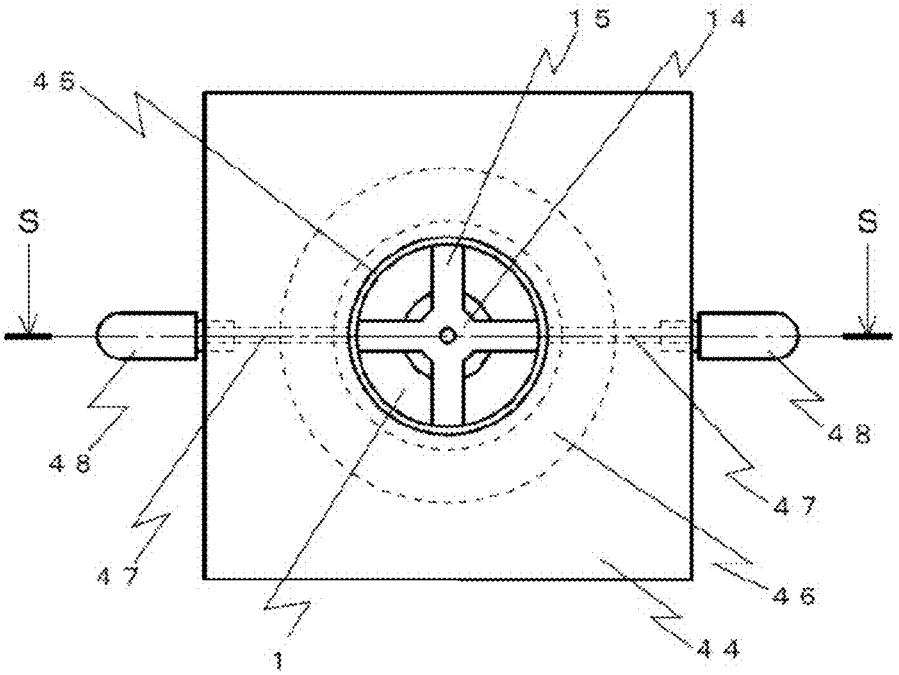
(a)

[Fig. 10]
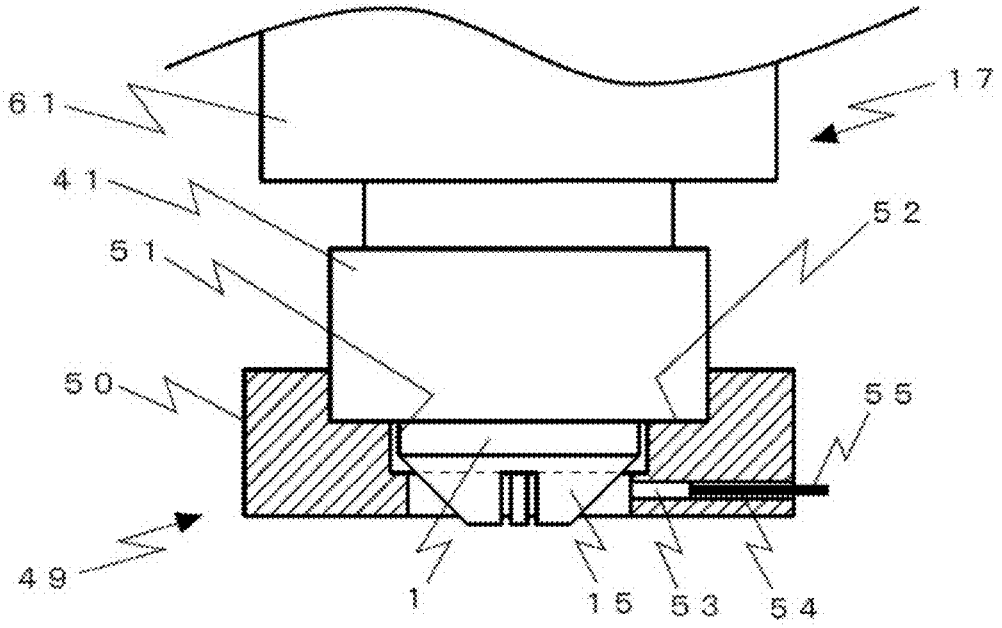
(b)
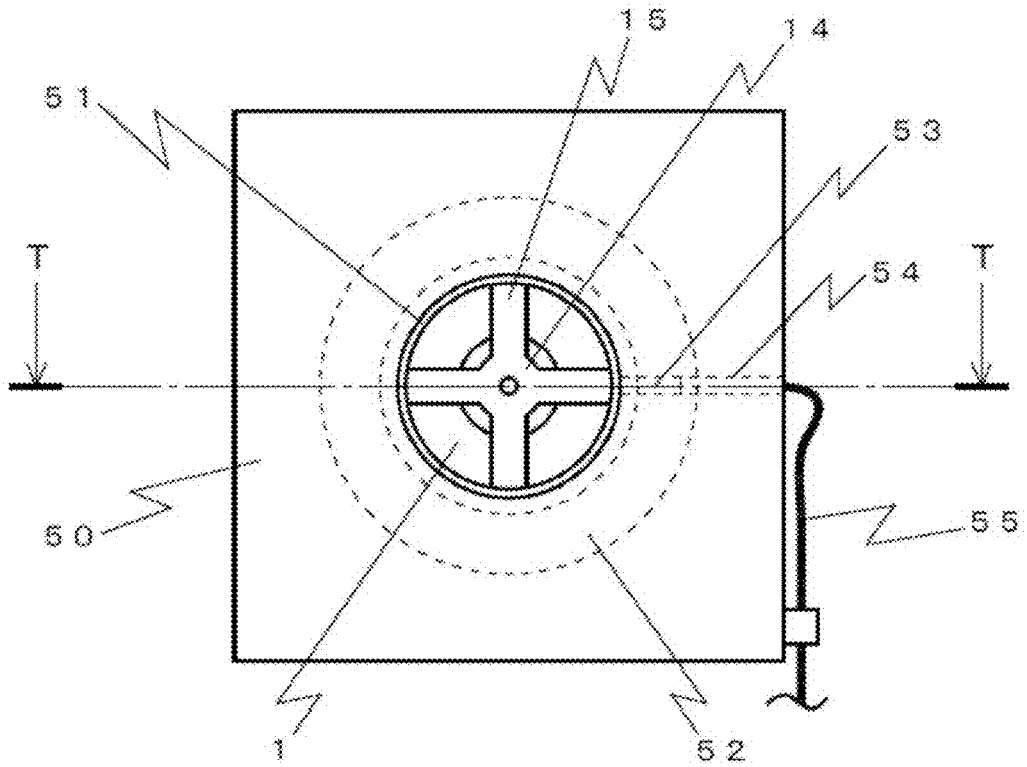
(a)

[Fig. 11]
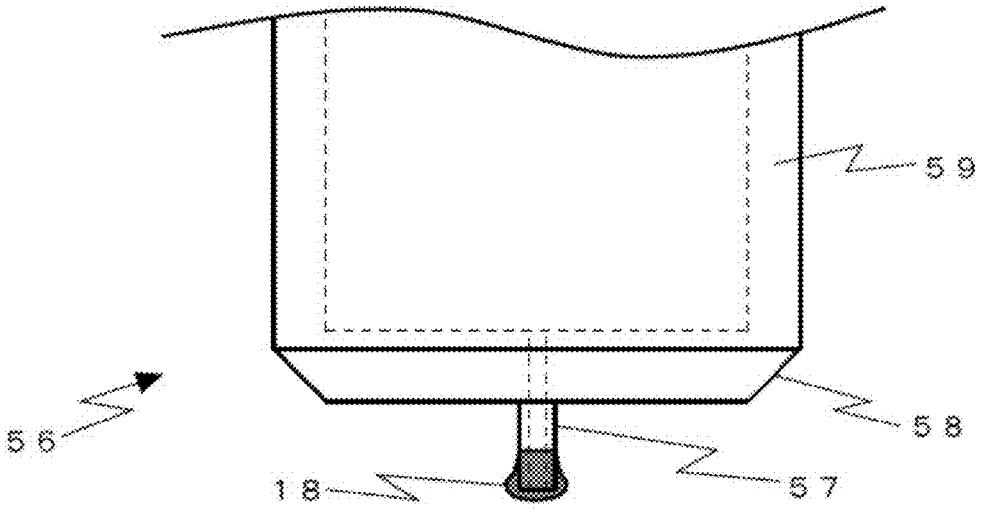
(b)
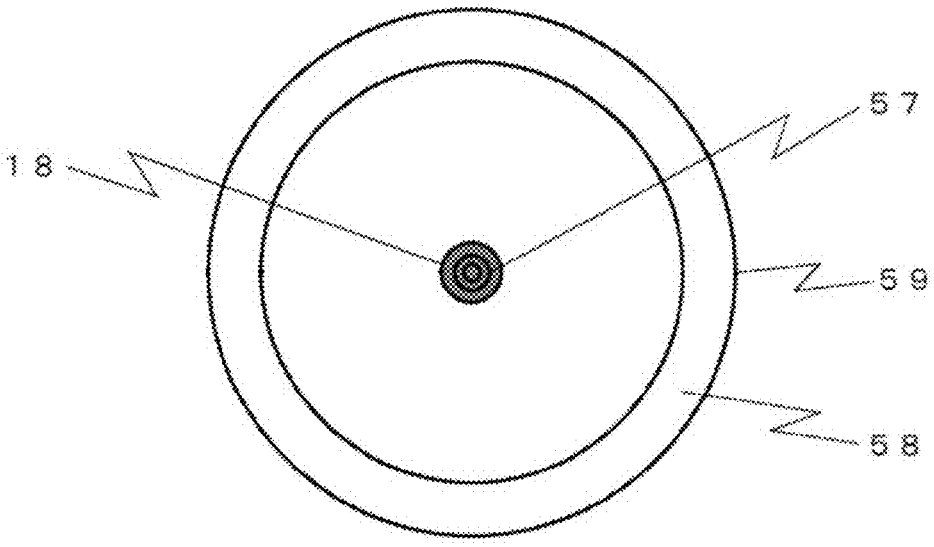
(a)

NOZZLE AND LIQUID MATERIAL DISCHARGE DEVICE PROVIDED WITH SAID NOZZLE

TECHNICAL FIELD

The present invention relates to an improvement in a nozzle of a liquid material discharge device, and more particularly to a nozzle capable of removing an surplus liquid material adhered to outer surfaces of the nozzle, and to a liquid material discharge device provided with the nozzle.

BACKGROUND ART

In a liquid material discharge device, when a liquid material 18 is continuously discharged, there often occurs a phenomenon (see FIG. 11), called "creeping and climbing", that the surplus liquid material 18 adheres to nozzle outer surfaces, such as a distal end surface and an outer lateral surface of a discharge tube 57 of a nozzle 56 due to the influences of surface tension, etc. The occurrence of the "creeping and climbing" causes a problem that, due to the influences of the liquid material 18 adhered to the outer surfaces of the nozzle 56 (particularly, the distal end surface of the discharge tube 57), variations generate in a discharge rate, or the discharged liquid material 18 has a shape different from the intended one (for example, the intended circular shape is deformed to an elliptic or another distorted shape).

Particularly, in a discharge device of the type that the liquid material departs from a nozzle before reaching a coating object (hereinafter referred to as the "flying discharge type"), there occurs, in addition to the above-described problem, an another problem that the liquid material does not depart from the nozzle and does not reach the coating object, or that a flying direction bends. The liquid material remaining adhered to the nozzle may further adversely affect the discharge, or may no longer stay there with increasing weight and may adhere to an unexpected position of the coating object, thus making the problem more serious.

In view of the problems described above, various techniques for avoiding the "creeping and climbing" of the liquid material and keeping the nozzle in a clean state have been proposed so far.

Patent Document 1 discloses a wiping device including a pair of wiping rollers that are rotated in opposite directions with a tip of a coating nozzle inserted between the pair of wiping rollers, and a pitch feed device that moves the wiping rollers through a certain distance in an axial direction, wherein, after moving the nozzle to a position above the wiping device, the nozzle is descended until it is inserted between the wiping rollers, and a motor is rotated while the nozzle is kept in a descended state, such that the rollers wipe off an adhesive, etc. remaining on outer surfaces of the nozzle.

Patent Document 2 discloses a device including scraping means provided with a scraping member that has a length spanning over a tip opening of a discharge nozzle, and with a reciprocating mechanism that reciprocally moves the scraping member in a direction perpendicular to a discharge direction in a state of the scraping member being in contact with the tip opening of the discharge nozzle, wherein, after a flowing material has been coated on a coating object member and when the flowing material is in a state projecting from the tip opening of the discharge nozzle, a scraping step is performed to scrape off the remaining flowing material.

Patent Document 3 discloses a nozzle cleaner including an inverted conical recess into which a nozzle tip is removably inserted, a cylindrical cleaning hole extending from a lower end opening of the recess exactly downwards and allowing the nozzle tip to be inserted into the cleaning hole, an air supply path having a blow opening between the recess and the cleaning hole, and ejecting compressed air therethrough, and an air suction path communicating with the cleaning hole and allowing the compressed air and a blown-off paste material to be expelled out under suction therethrough, wherein a nozzle is inserted into both the recess and the cleaning hole, and the compressed air is ejected from the blow opening such that the paste material adhered to a lower end portion of the nozzle is blown off and expelled out under suction through the air suction path.

Patent Document 4 discloses a device including a cleaning chamber that has a funnel portion, first solvent supply means for supplying a solvent to the funnel portion, second solvent supply means for supplying a solvent to an upper side of the funnel portion, and nozzle suction means, wherein when a nozzle is positioned in the cleaning chamber, the surface of a treatment liquid in the nozzle is retracted by the suction means, the solvent is supplied from the first solvent supply means to form a vortex flow of the solvent and to clean the nozzle, the solvent is supplied from the second solvent supply means to form a liquid pool within the cleaning chamber, and the suction means performs suction to form a treatment liquid layer, an air layer, and a solvent layer inside a nozzle tip.

CITATION LIST

Patent Documents

Patent Document 1: Japanese Patent Laid-Open Publication No. 2002-79151

Patent Document 2: Japanese Patent Laid-Open Publication No. 2005-246139

Patent Document 3: Japanese Patent Laid-Open Publication No. 2007-216191

Patent Document 4: Japanese Patent Laid-Open Publication No. 2010-62352

SUMMARY OF INVENTION

Technical Problems

The techniques disclosed in the above-cited Patent Documents 1 to 4 have the following problems.

(1) A complicated mechanism is needed to remove the liquid material adhered to the outer surfaces of the nozzle. Hence the number of parts and the cost are increased.

(2) A place for installment of the above-mentioned mechanism is needed. In other words, a device for removing the liquid material is required in addition to the discharge device. Hence the size of the discharge device is increased.

(3) The operation for removing the liquid material is needed, and an operating rate of the discharge device is reduced. Furthermore, since the control for removing the liquid material is also needed, an entire control process is also complicated.

To cope with the above problems, an object of the present invention is to provide a nozzle easily capable of removing a surplus liquid material, which is adhered to outer surfaces of the nozzle and which affects a discharge operation, without undergoing a special process, and a liquid material discharge device provided with the nozzle.

Solution to Problem

The inventor has come up with an idea that the size of a discharge device can be reduced and the manufacturing and operating costs can be cut down by providing a structure capable of removing a surplus liquid, which is adhered to the outer surfaces of the nozzle, without operating any member. The inventor has accomplished the present invention on the basis of such an idea by finding the fact that the liquid can be prevented from staying at a nozzle tip by sucking the surplus liquid material, which is adhered to the outer surfaces of the nozzle, with the action of capillary force. Thus, the present invention is constituted by the following technical means.

A nozzle for discharging a liquid material, according to the present invention, comprises a body having a liquid inflow space, and a discharge tube communicating with the liquid inflow space and extending downwards from the body, wherein a liquid removing member is disposed at a lower end of the body in a state laterally surrounding the discharge tube, and the liquid removing member includes a groove-like space that is formed between adjacent to of plural surrounding surfaces, and that generates capillary force acting in a direction laterally away from the discharge tube. Preferably, the liquid removing member includes the plural surrounding surfaces that surround a lateral surface of the discharge tube, and that generate capillary force acting in a direction towards a base of the discharge tube in cooperation with the lateral surface of the discharge tube.

In the above nozzle for discharging the liquid material according to the present invention, the groove-like space may be constituted by a pair of guide surfaces that are disposed in an opposing relation. In this connection, a distance between the pair of guide surfaces is preferably 1 to 3 times an outer diameter of the discharge tube. A distance between each of the surrounding surfaces and the outer lateral surface of the discharge tube is preferably 1 to 3 times the outer diameter of the discharge tube. Furthermore, the distance between the pair of guide surfaces and the distance between each of the surrounding surfaces and the outer lateral surface of the discharge tube are each preferably 2000 μm or less.

In the above nozzle for discharging the liquid material according to the present invention, a space defined by the surrounding surfaces and surrounding the lateral surface of the discharge tube may be a cylindrical space.

In the above nozzle for discharging the liquid material according to the present invention, the groove-like space may be constituted as a plurality of groove-like spaces. In this connection, preferably, the plurality of groove-like spaces are arranged in a state radially extending from the discharge tube at evenly distributed intervals therebetween.

In the above nozzle for discharging the liquid material according to the present invention, a height of the liquid removing member may be equal to or less than a length of the discharge tube. A liquid material discharge device of air type, according to the present invention, comprises the just above-described nozzle for discharging the liquid material, a syringe storing the liquid material and having a distal end to which the nozzle for discharging the liquid material is fitted, and an air supply tube through which pressurized gas is supplied to the syringe, wherein the length of the discharge tube is 1.2 to 1.5 times the height of the liquid removing member.

Another liquid material discharge device according to the present invention is a liquid material discharge device comprising the above-described other type of nozzle for discharging the liquid material.

The above liquid material discharge device according to the present invention may further comprise a vacuum mechanism and a suction device, wherein the vacuum mechanism may include a block-like member provided with a through-hole having an inner side opening positioned near the liquid removing member, and an outer side opening of the through-hole in the block-like member may be connected to the suction device. In this connection, the liquid material discharge device may further comprise a liquid amount detection mechanism and a liquid amount detection device, wherein the liquid amount detection mechanism may include a sensor inserted in a through-hole of the block-like member, and the sensor may be connected to the liquid amount detection device.

The above liquid material discharge device according to the present invention may further comprise a liquid amount detection mechanism and a liquid amount detection device, wherein the liquid amount detection mechanism may include a block-like member that surrounds the nozzle for discharging the liquid material, a sensor hole formed in the block-like member and having an opening positioned near the liquid removing member, and a sensor inserted in the sensor hole, the sensor being connected to the liquid amount detection device.

Advantageous Effect of Invention

According to the present invention, the surplus liquid material adhered to the outer surfaces of the nozzle and affecting the discharge operation can be removed by the action of capillary force without undergoing a manual or mechanical liquid removing operation.

BRIEF DESCRIPTION OF THE DRAWINGS

FIG. 1 is a perspective view illustrating one embodiment of a nozzle according to the present invention.

FIGS. 2(*a*) and 2(*b*) are respectively a bottom view and a front view illustrating the one embodiment of the nozzle according to the present invention.

FIG. 3 is a sectional view taken along a line A-A in FIG. 2.

FIG. 4 is an explanatory view referenced to explain the operation of the nozzle according to the present invention; specifically FIG. 4(*a*) illustrates a state where a liquid material reaches surrounding surfaces, FIG. 4(*b*) illustrates a state where the liquid material reaches a base of a discharge tube, FIG. 4(*c*) illustrates a state where the liquid material advances in groove-like spaces defined by flat walls, and FIG. 4(*d*) illustrates a state where the liquid material reaches outermost ends of the groove-like spaces.

FIG. 5 is a partly-sectioned schematic view of a discharge device of flying discharge type according to Example 1.

FIG. 6 is a schematic side view of a discharge device of air type according to Example 2.

FIG. 7 is a bottom view referenced to explain one or more groove-like spaces formed in a nozzle according to Example 3; specifically FIG. 7(*a*) illustrates the case having one groove, FIG. 7(*b*) illustrates the case having two grooves, FIG. 7(*c*) illustrates the case having three grooves, FIG. 7(*d*)

illustrates the case having five grooves, and FIG. 7(*e*) illustrates the case having six grooves.

FIG. 8 is an explanatory view referenced to explain an outer wall of a nozzle according to Example 4; specifically, FIG. 8(*a*) is a bottom view, and FIG. 8(*b*) is a sectional view taken along a line R-R in FIG. 8(*a*).

FIG. 9 is an explanatory view referenced to explain a vacuum mechanism according to Example 5; specifically, FIG. 9(*a*) is a bottom view, and FIG. 9(*b*) is a sectional view taken along a line S-S in FIG. 9(*a*).

FIG. 10 is an explanatory view referenced to explain a liquid amount detection mechanism according to Example 6; specifically, FIG. 10(*a*) is a bottom view, and FIG. 10(*b*) is a sectional view taken along a line T-T in FIG. 10(*a*).

FIG. 11 is an explanatory view referenced to explain a nozzle of prior art; specifically, FIG. 11(*a*) is a bottom view, and FIG. 11(*b*) is a front view.

DESCRIPTION OF EMBODIMENTS

An embodiment for carrying out the present invention will be described below.

<Structure>

FIG. 1 is a perspective view illustrating one embodiment of a nozzle according to the present invention. FIGS. 2(*a*) and 2(*b*) are respectively a bottom view and a front view illustrating the one embodiment of the nozzle according to the present invention. FIG. 3 is a sectional view taken along a line A-A in FIG. 2. In the following description, the side including a discharge tube is called the "lower side", and the side including a flange is called the "upper side" in some cases. Moreover, the peripheral side where the flange is formed is called the "outer side", and the side including a center axis of a body is called the "inner side" in some cases.

A nozzle 1 in this embodiment mainly includes a cylindrical body 2, a discharge tube 4, and a liquid removing member 16.

The body 2 is hollow, and a space inside the body is defined by an inner lateral surface 8 of the body and an inner surface 9 of a body closing wall. An outer surface 3 of the body closing wall, which defines at its upper side the body closing-wall inner surface 9, is formed to extend perpendicularly to a body axis passing a center of a discharge path 5 (namely, to extend horizontally), thereby closing a lower end of the body 2. A discharge tube 4 is attached perpendicularly to the body closing-wall outer surface 3, and it has the discharge path 5 communicating with the inner space of the body and with the outside. An opening 6 is formed at an upper end of the body 2. A flange 7 extending horizontally is provided at the upper end of the body 2 and surrounds the opening 6.

The liquid removing member 16 is joined to the lower end of the body 2. The liquid removing member 16 may be formed integrally with the body 2, or may be removably joined to the body 2. The liquid removing member 16 includes a cylindrical surrounding space 14 that is defined by surrounding surfaces 10 and the body closing-wall outer surface 3, and further includes groove-like spaces 15 that are defined by guide surfaces 11 and the body closing-wall outer surface 3. The liquid removing member 16 functions to suck, with the action of capillary force, a surplus liquid material adhered to outer surfaces of the discharge tube 4. The liquid removing member 16 in this embodiment includes four sector-shaped projections separated by the groove-like spaces 15 that are arranged in a cruciform when viewed from below (see FIG. 2(*a*)). The four sector-shaped projections are same in shape, and each of the sector-shaped projections has the guide surfaces 11 defining outer lateral surfaces of the groove-like spaces 15, and the surrounding surface 10 adjacent to the guide surfaces 11. Furthermore, each sector-shaped projection has a distal end surface 12 and a sloped surface 13 on the lower side. The liquid removing member 16 in this embodiment is constituted as follows.

The four surrounding surfaces 10 are arranged around the discharge tube 4 in a symmetrical relation with respect to the discharge tube 4 while a predetermined distance is held between each of the surrounding surfaces 10 and the discharge tube 4. The surrounding surface 10 positioned to face an outer lateral surface of the discharge tube 4 has a surface curved following the shape of the outer lateral surface of the discharge tube 4, and is formed to extend perpendicularly to the body closing-wall outer surface 3. The surrounding surface 10 preferably has the curved surface that defines a circle in a concentric relation to the cylindrical discharge tube 4. However, it is not essential that the surrounding surface 10 has the concentric curved surface. The surrounding surface 10 is contiguous to the two guide surfaces 11 and the distal end surface 12, which are all substantially orthogonal to the surrounding surface 10. The guide surfaces 11 are each a flat surface extending perpendicularly to the body closing-wall outer surface 3. Each guide surface 11 has one end in continuation with the surrounding surface 10, and extends outwards in a radial direction of the body 2. The distal end surface 12 is a flat surface parallel to the body closing-wall outer surface 3 and defines respective ends of the surrounding surface 10 and the guide surfaces 11. The sloped surface 13 in continuation with an outer surface of the liquid removing member 16 is formed to extend as an outer lateral surface of the body 2 in its lower end portion. However, it is not essential that the sloped surface 13 is formed as described above. For example, the sloped surface 13 may be formed not to extend over the body 2 as described later (in Example 4).

Thus, the above-described walls (corresponding to 3, 10, 11 and 12) form the plural spaces (14 and 15), which generate the action of capillary force, around the discharge tube 4. First, the cylindrical surrounding space 14 is formed between the surrounding surfaces 10 and the outer surface of the discharge tube 4 so as to surround the discharge tube 4. The expression "cylindrical" used here involves the cases where a horizontal cross-section has an equilateral hexagonal or more polygonal shape (in which an inner surface defined by each side may be a curved surface), such as an equilateral hexagonal shape, an equilateral octagonal shape, an equilateral decagonal shape, or an equilateral dodecagonal shape. Furthermore, the guide surfaces 11 are formed in four pairs in each of which the two guide surfaces 11 extend in the radial direction of the body 2 in a relation opposing to each other with a predetermined distance kept therebetween. Thus, the four groove-like spaces 15 are each formed between one pair of the guide surfaces 11. The groove-like spaces 15 in the embodiment are a plurality of rectangular parallelepiped spaces arranged to radially extend from the discharge tube 4 (or the surrounding space 14), and they establish communication between the surrounding space 14 and the outside. Speaking from another point of view, the liquid removing member 16 is obtained by preparing a truncated conical member that can be attached to the body 2, cutting out a cylindrical central portion of the truncated conical member to form the surrounding space 14 to which the outer surfaces of the discharge tube 4 are exposed, and further cutting the truncated conical member to form grooves that extend outwards from the surrounding space, thus forming the groove-like spaces 15.

The height (vertical length) of each of the surrounding surfaces 10 and the guide surfaces 11 is preferably equal to the length of the discharge tube 4 or lower than the discharge tube 4. Stated in another way, the length of the discharge tube 4 is preferably equal to or larger than the height of each of the surrounding surfaces 10 and the guide surfaces 11. The reason resides in that, if the surrounding surfaces 10 and the guide surfaces 11 are higher than the discharge tube 4, a liquid material 18 is positioned lower than a distal end surface of the discharge tube 4 when the liquid material 18 reaches the surrounding surfaces 10, and the liquid material 18 is more apt to adhere to the distal end surface of the discharge tube 4. This embodiment represents the case where the length of the discharge tube 4 is equal to the height of each of the surrounding surfaces 10 and the guide surfaces 11. A practical example in which the discharge tube 4 is longer than the surrounding surfaces 10 and the guide surfaces 11 will be described later in Example 2.

The groove-like space 15 is provided one or plural. When the plural groove-like spaces 15 are provided, they are preferably arranged at evenly distributed intervals therebetween. The reason resides in that, if the plural groove-like spaces 15 are arranged at unevenly distributed intervals therebetween, the liquid material 18 would unevenly enter the individual groove-like spaces 15, and a wasteful empty space is generated in the groove-like space 15 where the liquid material 18 enters in a relatively small amount. In this embodiment, the four groove-like spaces 15 are arranged in a cruciform. While this embodiment represents the case of providing the four groove-like spaces 15, the present invention is not limited to that case. Exemplary variations of the number and the layout of the groove-like spaces 15 will be described below in Example 3.

In consideration of balance between the capillary force and the later-described action for pooling the liquid material 18, the widths of the surrounding space 14 and the groove-like space 15 are each preferably equal to or larger than the outer diameter of the discharge tube 4 in the nozzle. In practice, the widths of the surrounding space 14 and the groove-like space 15 are each preferably one to three times the outer diameter of the discharge tube 4 in the nozzle.

<Operation>

The operation of the nozzle 1 according to the present invention will be described below with reference to FIG. 4. Among eight drawings included in FIG. 4, each drawing suffixed with a numeral "1" is a bottom view, and each drawing suffixed with a numeral "2" is a sectional view taken along a one-dot-chain line in the corresponding drawing denoted by the same alphabet that is suffixed with the numeral "1".

FIGS. 4(*a*1) and 4(*a*2): When the discharge is continuously performed in the liquid material discharge device, the liquid material 18 starts to creep over the distal end surface and to climb along the outer lateral surface of the discharge tube 4. With the liquid material 18 creeping and climbing in an increasing amount, the liquid material 18 soon reaches the surrounding surfaces 10. Upon the liquid material 18 reaching the surrounding surfaces 10, capillary force tending to carry the liquid material 18 upwards (towards the base of the discharge tube 4) starts to generate with the cooperative action between the surrounding surfaces 10 and the outer surface of the discharge tube 4, thus causing the climbing liquid material 18 to be pulled into the cylindrical surrounding space 14 that is defined by the surrounding surfaces 10 and the outer surface of the discharge tube 4. At that time, since the liquid material 18 at the distal end surface of the discharge tube 4 is pulled into the surrounding space 14 by the capillary force, the liquid material 18 at the distal end surface of the discharge tube 4 is removed.

FIGS. 4(*b*1) and 4(*b*2): Thereafter, while the amount of the liquid material 18 adhered to the outer surfaces of the discharge tube 4 increases, the liquid material 18 is continuously carried in the surrounding space 14 upwards (towards the base of the discharge tube 4) by the capillary force generated with the cooperative action between the surrounding surfaces 10 and the outer surface of the discharge tube 4. Such movement of the liquid material 18 is continued until the liquid material 18 reaches the base of the discharge tube 4. In other words, the liquid material 18 continuously moves upwards until the cylindrical surrounding space 14 defined by the surrounding surfaces 10 and the outer surface of the discharge tube 4 is filled with the liquid material 18. It is to be noted that, during a time until the cylindrical surrounding space 14 is filled with the liquid material 18, the capillary force continues to act on the liquid material 18 adhered to the distal end surface of the discharge tube 4, and hence the distal end surface of the discharge tube 4 is maintained in a state where the liquid material 18 is hardly present.

FIGS. 4(*c*1) and 4(*c*2): With further progress of the creeping and climbing of the liquid material 18, the liquid material 18 enters the groove-like spaces 15 each defined by the two guide surfaces 11. In each of the groove-like spaces 15, capillary force tending to carry the liquid material 18 in a direction separating from the outer lateral surface of the nozzle 2 (i.e., outwards in the radial direction) starts to generate with the action of the two guide surfaces 11, thus causing the liquid material 18 in the cylindrical surrounding space 14 to be withdrawn into the groove-like space 15. Even in this stage, since the liquid material 18 at the distal end surface of the discharge tube 4 is pulled into the groove-like space 15 from the surrounding space 14, the distal end surface of the discharge tube 4 is maintained in the state where the liquid material 18 is hardly present. Moreover, even in this stage, the capillary force generated between the surrounding surfaces 10 and the outer surface of the discharge tube 4 still acts in some cases. Thus, in some cases, the liquid material 18 adhered to the outer surfaces of the discharge tube 4 is subjected to both the force acting to move the liquid material 18 upwards in the surrounding space 14 (i.e., towards the base of the discharge tube 4) and the force acting to pull the liquid material 18 into the groove-like space 15 at the same time.

FIGS. 4(*d*1) and 4(*d*2): When the liquid material 18 further continues creeping and climbing and eventually reaches an outermost end of the groove-like space 15, the capillary force is no longer generated in the groove-like space 15. Upon reaching such a state, it is desirable, for example, to exchange the nozzle 1 or to draw out the liquid material 18. However, a long time is taken until reaching the above-mentioned state, and the liquid material 18 is usually exhausted up or replaced with another type during such a long time. It is hence thought that the above-mentioned state generally does not occur in most practical cases.

With the nozzle 1 according to the present invention, as described above, since the capillary force is generated with the cooperative action among the discharge tube 4, the surrounding surfaces 10, and the guide surfaces 11, the latter twos being formed around the discharge tube 4, the surplus liquid material 18 adhered to the outer surfaces of the discharge tube 4 can be removed.

Furthermore, since there are not only the cylindrical surrounding space 14 defined by the discharge tube 4 and by the surrounding surfaces 10 formed around the discharge tube 4, but also the plural groove-like space 15 defined by the plural guide surfaces 11, a certain amount of the liquid material 18 can be held in those spaces. Accordingly, the liquid material 18 is not required to be removed at once, and the capillary force can be generated to perform the proper action for a certain time.

A suction device, such as a vacuum generation source, may be connected to the groove-like spaces 15 such that the surplus liquid material 18 may be removed as required.

In addition, with the nozzle 1 according to the present invention, since the liquid removing member 16 surrounds the discharge tube 4, the discharge tube 4 can be prevented from contacting any things at the outside. This feature is more effective in a discharge tube for use in minute-amount discharge because the discharge tube 4 is more susceptible to deformation or breakage upon contact from the outside as the diameter of the discharge tube 4 decreases.

The above-described nozzle according to the present invention is suitably used in, e.g., a discharge device of flying discharge type in which a plunger is advanced and then abruptly stopped to apply inertial force to a liquid material, thereby discharging the liquid material, or an discharge device of air type in which air under regulated pressure is applied for a desired time to a liquid material that is stored in a syringe including a nozzle at its end. As the discharge device of the flying discharge type, there are a jet type operating a plunger to be seated against a valve seat, and another jet type operating a plunger to be not seated against a valve seat.

Details of the present invention will be described below in connection with Examples, but it is to be noted that the present invention is in no way limited by the following Examples.

Example 1

FIG. 5 is a partly-sectioned view of a discharge device of the flying discharge type according to Example 1.

In a discharge device 17 according to this Example, a liquid material 18 is discharged from a discharge tube 4 of a nozzle 1 in a flying mode by vertically moving a rod 20 such that a tip of the rod 20 causes an action on an entrance of a discharge flow path 5 formed in the discharge tube 4 of the nozzle 1. The discharge device 17 mainly includes a driver unit 19 for driving the rod 20 in an up-and-down direction, and a discharge unit 31 for discharging the liquid material 18 with the action of the driven rod 20.

According to the discharge device 17 of Example 1, coating and drawing in a desired pattern can be realized by discharging the liquid material 18 from the nozzle 1 in the form of droplets while the nozzle 1 and a work are moved relatively.

The driver unit 19 includes a driver main body 60 having a piston chamber therein, which is divided into a spring chamber 23 and an air chamber 24 by a piston 21. The piston 21 is fixed to the rod 20 and is slidable within the piston chamber in the up-and-down direction. A sealing member 30 is disposed over a lateral surface of the piston 21 such that compressed air having flowed into the air chamber 24 will not leak. At the upper side of the piston 21, the spring chamber 23 is formed to accommodate a spring 22 for driving the rod 20 to descend. At the lower side of the piston 21, the air chamber 24 is formed to receive the compressed air that flows into the air chamber 24 for driving the rod 20 to ascend. Above the spring chamber 23, a stroke adjustment screw 25 is disposed to restrict the movement of the rod 20 and to adjust a stroke of the rod 20, i.e., a distance through which the rod 20 is moved. The stroke adjustment is made by changing a distance between a lower end of the stroke adjustment screw 25 and an upper end of the rod 20. The compressed air is supplied to flow into the air chamber 24 from a compressed air source (not illustrated) through an air supply tube 27 and a selector valve 26. The compressed air in the air chamber 24 flows out through the selector valve 26 and an exhaust tube 28. The selector valve 26 is constituted by, e.g., a solenoid valve or a high-speed response valve, and is controlled to be opened and closed by a controller (not illustrated) to which the selector valve 26 is connected via a control line 29.

The discharge unit 31 includes a discharge main body 61 having a liquid chamber 32 in which an end portion of the rod 20 moves up and down. A connection member 33 having a through-hole through which the rod 20 penetrates is arranged above the liquid chamber 32, and a sealing member 34 is disposed in the through-hole to prevent leakage of the liquid material from the liquid chamber 32. A valve seat 35 is attached at the bottom of the liquid chamber 32, and it has a communication hole 36 that is formed to penetrate through a center of the valve seat 35 for communication between the liquid chamber 32 and the discharge tube 4. A supply path 37 is formed to extend from a lateral surface of the liquid chamber 32 for communication between the liquid chamber 32 and a reservoir 39. The liquid material 18 stored in the reservoir 39 is supplied to the liquid chamber 32 through an extended-out portion 38. In addition, compressed gas for feeding the liquid material 18 under pressure is supplied to the reservoir 39 through an adaptor tube 40.

The rod 20 is moved at a high speed towards the valve seat 35 in a state where a lateral surface of the rod 20 is not contacted with an inner lateral surface of the liquid chamber 32. The rod 20 is then hit against the valve seat 35, whereby the liquid material 18 can be discharged from the nozzle 1 in the form of droplets. Alternatively, a mechanism for quickly moving the rod 20 to advance and then abruptly stopping the rod 20 without causing the rod 20 to be hit against the valve seat 35 may be disposed such that inertial force is applied to the liquid material 18 to discharge the liquid material 18 in the form of droplets by advancing the rod 20 at a high speed and then abruptly stopping the rod 20.

The nozzle 1 used in Example 1 is the nozzle illustrated in FIGS. 1 to 4. Because a basic structure of the nozzle 1 has been described above, duplicate description is omitted. The discharge tube 4 used in Example 1 has an inner diameter of, e.g., $\phi$ 100 to 400 μm, an outer diameter that is 1.5 to 3 times the inner diameter, and a length that is several times the inner diameter. The distance from the outer lateral surface of the discharge tube 4 to each surrounding surface 10 is 1 to 3 times the outer diameter of the discharge tube 4, and the height (vertical length) of each surrounding surface 10 is equal to the length of the discharge tube 4. The height (vertical length) of each guide surface 11 is equal to the length of the discharge tube 4, and the distance between the pair of guide surfaces 11 and 11 disposed in an opposing relation is the same as that from the outer lateral surface of the discharge tube 4 to each surrounding surface 10. It is to be noted that the distance from the outer lateral surface of the discharge tube 4 to each surrounding surface 10 and the distance between the pair of guide surfaces 11 and 11 are each preferably 2000 μm or less.

The above nozzle 1 is removably fixed, together with the valve seat 35, to the lower end of the liquid chamber 32 by a nozzle fixture 41. The liquid material 18 supplied through the supply path 37 is discharged to the outside after passing, from the liquid chamber 32, through the communication hole 36 in the valve seat 35 and the discharge path 5 in the discharge tube 4 of the nozzle 1.

According to the above-described discharge device 17 of Example 1, even when the creeping and climbing of the liquid material 18 occur with the continued discharge, the surplus liquid material 18 adhered to the distal end surface of the discharge tube 4 can be removed because the nozzle 1 includes the liquid removing member 16. Since the liquid removing member 16 provided in the nozzle 1 is a member having a small size not exceeding the length of the discharge tube 4, the size of the discharge device 17 is not increased. Furthermore, since the liquid removing member 16 is a fixed member and has a simple structure, the manufacturing cost is held low. In addition, since a special operation for removing the surplus liquid material adhered to the distal end surface of the discharge tube 4 is not necessary, a high operating rate of the discharge device 17 can be realized.

Example 2

FIG. 6 is a schematic side view of a discharge device of air type according to Example 2.

A discharge device 42 according to this Example mainly includes a reservoir 39 for storing a liquid material 18 therein, and an adaptor tube 40 to which compressed air needed for discharging the liquid material 18 is supplied. A nozzle 1 including a cylindrical surrounding space 14 and groove-like spaces 15 is removably screwed to an end (lower end) of the reservoir 39 on the side opposite to an end to which the adaptor tube 40 is attached. The nozzle 1 used in Example 2 has a basic structure common to that of the nozzle 1 used in Example 1, but it is different from the nozzle 1 used in Example 1 in that the depth of each of the cylindrical surrounding space 14 and the groove-like spaces 15 is shallower than that corresponding to the length of the discharge tube 4 (namely, the height of each of the surrounding surfaces 10 and the guide surfaces 11 is comparatively low). The reason is described later.

In the discharge device 42 of the air type, unlike the discharge device 17 of the flying discharge type, the liquid material 18 flowing out from the discharge tube 4 departs from the discharge tube 4 after having attached to a coating object. Thus, the liquid material 18 is discharged in a state where a tip of the discharge tube 4 is positioned very close to the coating object to such an extend as substantially in contact therewith. Therefore, if the length of the discharge tube 4 is equal to the height of each of the surrounding surfaces 10 and the guide surfaces 11 as in Example 1, the liquid removing member 16 having the truncated conical shape would contact the liquid material 18 after being discharged, thereby causing problems. For that reason, in the discharge device of the type in which the liquid material 18 departs from the nozzle 1 after having attached to the coating object, like the air-type discharge device, the length of the discharge tube 4 is preferably longer than that corresponding to the height (i.e., the vertical length) of the liquid removing member 16. In practice, when the length of the discharge tube 4 is set to be within 1.5 times and more preferably 1.2 times the height of each of the surrounding surfaces 10 and the guide surfaces 11, the capillary force is generated to act in a way described above, and similar advantageous effects to those obtained with the above-described nozzles (i.e., the nozzles in which the length of the discharge tube 4 is equal to the height of each of the surrounding surfaces 10 and the guide surfaces 11) can be obtained. Taking into account a possibility that the liquid removing member 16 may contact the liquid material 18 after being discharged, the length of the discharge tube 4 is preferably set to fall within a range of 1.2 to 1.5 times the height (vertical length) of the liquid removing member 16.

According to the above-described air-type discharge device 42 of Example 2, in spite of being the discharge type in which the liquid material 18 flowing out from the discharge tube 4 departs from the discharge tube 4 after having attached to the coating object, it is possible to remove the surplus liquid material 18 adhered to the distal end surface of the discharge tube 4.

Example 3

Example 3 relates to variations of the groove-like space 15 formed one or plural in the nozzle 1. FIG. 7 is a bottom view referenced to explain modifications in layout of the one or more groove-like spaces 15 formed in the nozzle 1. Specifically, FIG. 7(*a*) illustrates the case having one groove-like space 15, FIG. 7(*b*) illustrates the case having two groove-like spaces 15, FIG. 7(*c*) illustrates the case having three groove-like spaces 15, FIG. 7(*d*) illustrates the case having five groove-like spaces 15, and FIG. 7(*e*) illustrates the case having six groove-like spaces 15. Which type of the nozzle 1 is to be used is optionally selected depending on, e.g., physical properties (such as viscosity and constituent matters) of the liquid material 18, and how long time or at what number of times the discharge is performed continuously. In any of the cases (b) to (e), volumes of the individual groove-like spaces 15 are substantially the same. When the plural groove-like spaces 15 are present, those groove-like spaces 15 are preferably arranged in a state radially extending from the cylindrical surrounding space 14 at evenly distributed intervals therebetween. The reason resides in that, if the groove-like spaces 15 are arranged at unevenly distributed intervals therebetween, the liquid material 18 would unevenly enter the individual groove-like spaces 15, and a wasteful empty space is generated in the groove-like space 15 where the liquid material 18 enters in a relatively small amount.

Each of the nozzles 1 including the one or more groove-like spaces 15 arranged in the above-described layouts (a) to (e) can be applied to any of the discharge device of the flying discharge type and the discharge device of the air type.

Example 4

FIG. 8(*a*) is a bottom view of a nozzle 1 according to Example 4, and FIG. 8(*b*) is a sectional view taken along a line R-R in FIG. 8(*a*).

In the nozzle 1 of this Example, an outer lateral surface of the body 2 does not have a sloped surface in its lower portion, and the length of a sloped surface 13 in the liquid removing member 16 is shortened to increase the area of a distal end surface 12 in comparison with that in Example 1 (FIGS. 1 to 3). Stated in another way, in this Example, the volume of a liquid retainable by the liquid removing member 16 is increased by enlarging the area of the distal end surface 12 and hence the area of each guide surface 11. From the viewpoint of increasing the retainable liquid volume, the height (vertical length) of the liquid removing member 16, i.e., the height of each of the surrounding surfaces 10 and the guide surfaces 11, is preferably set equal to the length of the discharge tube 4. Furthermore, the distance from the outer lateral surface of the discharge tube 4 to each of surrounding surfaces 10 is larger than that in Example 1 (e.g., 1.2 to 2 times the distance in Example 1), and the distance between the guide surfaces 11 and 11 is 1.2 to 2 times the distance from the outer lateral surface of the discharge tube 4 to each surrounding surface 10. Thus, in Example 4, gaps formed as the surrounding space 14 and the groove-like spaces 15 are wider than those in Example 1, and the liquid retainable volume is increased corresponding to the wider gaps. However, the distance from the outer lateral surface of the discharge tube 4 to each surrounding surface 10 and the distance between the pair of guide surfaces 11 and 11 are each preferably 2000 μm or less. The outer shape and the length of the discharge tube 4 and the shape of the inner space of the body are the same as those in Example 1.

Thus, according to the above-described nozzle of Example 4, because the volume of each groove-like space 15 is increased, the liquid material 18 can be pooled in the groove-like space 15 in a larger amount than in the nozzle 1 of Example 1.

Example 5

FIG. 9(*a*) is a bottom view of a nozzle 1 equipped with a vacuum mechanism according to Example 5, and FIG. 9(*b*) is a sectional view taken along a line S-S in FIG. 9(*a*). In these drawings, a discharge device is constituted, by way of example, as the discharge device of the flying discharge type similar to that in Example 1. In the nozzle 1 of Example 5, a vacuum mechanism 43 is added to the nozzle 1 of Example 1. In the following, description of a structure common to that in Example 1 is omitted, and only the vacuum mechanism 43, i.e., a structure added in Example 5, is described.

The vacuum mechanism 43 in this Example includes a block-like member 44 surrounding the nozzle 1, and a vacuum generation source (not illustrated) that is connected to the block-like member 44 through a coupling 48. A through-hole 45 into which the nozzle 1 is fitted is formed at a center of the block-like member 44. The through-hole 45 has a step-like shape in its vertical section, and a step formed at the upper side in the through-hole 45 serves as a support portion 46 providing a horizontal surface to which the nozzle fixture 41 of the discharge device 17 is supported in a contact state. A vent hole 47 is formed in the block-like member 44 at a position corresponding to a lower portion of the through-hole 45, which is in a surrounding relation to the groove-like spaces 15. The vent hole 47 interconnects an inner peripheral surface of the through-hole 45 and an outer surface of the block-like member 44. The vent hole 47 is arranged such that its opening opened to the inner peripheral surface of the through-hole 45 is positioned in alignment with a center line of the groove-like space 15. In an exemplary layout illustrated in FIG. 9, two groove-like spaces 15 and two vent holes 47 are aligned with each other on one straight line. However, the layout is not limited to the illustrated one. Two groove-like spaces 15 and two vent holes 47, every twos being arranged to lie perpendicularly to each other, may be disposed such that each pair of the groove-like space 15 and the vent hole 47 are positioned on one straight line. Alternatively, the vent hole 47 may be provided in the same number (i.e., four vent holes 47 in this Example) as that of the groove-like spaces 15.

One end of the vent hole 47 at the same side as the inner peripheral surface of the through-hole 45 is not always required to be positioned in flush with the inner peripheral surface of the through-hole 47, and the one end of the vent hole 47 may be formed to project inwards from the inner peripheral surface of the through-hole 47. With such an arrangement, the distance between the groove-like space 15 and the vent hole 47 is shortened, whereby stronger suction force can be generated. The coupling 48 is attached to the other end of the vent hole 47 at the same side as an outer lateral surface of the block-like member 44, and is connected to the vacuum generation source (not illustrated). The vacuum generation source operates to be able to suck the liquid material 18 that is pooled in the groove-like spaces 15 and the surrounding space 14 of the nozzle 1, and to remove the useless liquid from the nozzle 1. A solenoid valve (not illustrated) for switching on/off the vacuum action, and a filter (not illustrated) for preventing the sucked liquid material from entering the vacuum generation source, etc. are preferably disposed in a line between the coupling 48 and the vacuum generation source.

According to the above-described discharge device 17 of Example 5, since the vacuum mechanism 43 is disposed, stronger liquid suction force can be caused to act on the outer surfaces of the nozzle 1. Moreover, since the useless liquid material 18 can be separated and removed from the nozzle 1 at the appropriate times, a clean state where the useless liquid material 18 is not adhered to the outer surfaces of the discharge tube 4 can be always maintained, and the number of maintenance operations, such as wiping, can be further reduced.

Example 6

FIG. 10(*a*) is a bottom view of a nozzle 1 including a liquid amount detection mechanism according to Example 6, and FIG. 10(*b*) is a sectional view taken along a line T-T in FIG. 10(*a*). In these drawings, a discharge device is constituted, by way of example, as the discharge device of the flying discharge type similar to that in Example 1. In a nozzle 1 of Example 6, a liquid amount detection mechanism 49 is added to the nozzle 1 of Example 1. In the following, description of a structure common to that in Example 1 is omitted, and only the liquid amount detection mechanism 49, i.e., a structure added in Example 6, is described.

The liquid amount detection mechanism 49 in this Example includes a block-like member 50 surrounding the nozzle 1, and a sensor 53 for detecting the presence of a liquid in a non-contact manner. A through-hole 51 into which the nozzle 1 is fitted is formed at a center of the block-like member 50. The through-hole 51 has a step-like shape in its vertical section, and a step formed at the upper side in the through-hole 51 serves as a support portion 52 providing a horizontal surface to which the nozzle fixture 41 of the discharge device 17 is supported in a contact state. A sensor hole 54 is formed in the block-like member 50 at a position corresponding to a lower portion of the through-hole 51, which is in a surrounding relation to the groove-like spaces 15. The sensor 53 is fitted in the sensor hole 54 with its sensor surface directed towards the inner side of the through-hole 51. The sensor hole 54 is arranged such that its opening opened to an inner peripheral surface of the through-hole 51 is positioned in alignment with a center line of the groove-like space 15. In an exemplary layout illustrated in FIG. 10, one sensor hole 54 is provided corresponding to one of the four groove-like spaces 15. Although one sensor 53 is enough in practical use, the sensor 53 may be disposed at each of two to four locations for the purpose of increasing detection accuracy. When the sensor hole 54 is formed plural, the following layouts are disclosed by way of example. Two groove-like spaces 15 and two sensor holes 54 are aligned with each other on one straight line. Two groove-like spaces 15 and two sensor holes 54, every twos being arranged to lie perpendicularly to each other, are disposed such that each pair of the groove-like space 15 and the sensor hole 54 are positioned on one straight line. The sensor hole 54 is provided in the same number (i.e., four sensor holes 54 in this Example) as that of the groove-like spaces 15.

A connection line 55 is attached to the sensor 53 and is connected to a liquid amount detection device (not illustrated) after passing the outer surface side of the block-like member 50. The liquid amount detection device is a computer for monitoring a signal from the sensor 53 at a predetermined timing, and it is able to detect an amount of the liquid material present in the groove-like space 15 with high accuracy and to issue an alarm to the user. The liquid amount detection device may also operate as a control device (dispense controller) for controlling the operation of the discharge device 17. For example, an optical sensor or an ultrasonic sensor may be used as the sensor 53. The liquid amount detection mechanism 49 in this Example may be disposed in combination with the above-described vacuum mechanism 43. Thus, it is disclosed here that one or more of the plural sensor holes 54 formed in the block-like member 50 are employed as holes into which the sensors are inserted, and that one or more of the remaining sensor holes 54 are employed as the vent holes for the vacuum mechanism 43. The following case is disclosed by way of example. Four sensor holes 54 (or four vent holes 47) are disposed in the cruciform. Two groove-like spaces 15 and two sensor holes 54 aligned with each other on one straight line are employed as the vent holes for the vacuum mechanism 43, whereas the sensor 53 is fitted into the sensor hole 54 that is located at a position in an orthogonal relation to those vent holes.

According to the above-described discharge device 17 of Example 6, since the liquid amount detection mechanism 49 is disposed, it is possible, for example, to detect an excessive amount of the liquid material 18 pooled in the groove-like space 15 and the surrounding space 14 of the nozzle 1, and to prevent the liquid material from dropping undesirably onto a coating object and so on. Furthermore, since there is no need of routinely checking the amount of the surplus liquid material 18 pooled in the liquid removing member 16, an operating load can be reduced significantly. In addition, when the liquid amount detection mechanism 49 is employed in combination with the vacuum mechanism 43, stronger liquid suction force can be caused to act on the outer surfaces of the nozzle 1, and the useless liquid material 18 can be separated and removed from the nozzle 1 at the appropriate times.

LIST OF REFERENCE SIGNS

1: nozzle, 2: body, 3: outer surface of body closing wall, 4: discharge tube, 5: discharge path, 6: opening, 7: flange, 8: inner lateral surface of body, 9: inner surface of body closing wall, 10: surrounding surface, 11: guide surface, 12: distal end surface, 13: sloped surface, 14: surrounding space, 15: groove-like space, 16: liquid removing member, 17: discharge device (flying discharge type), 18: liquid material, 19: driver unit, 20: rod, 21: piston, 22: spring, 23: spring chamber, 24: air chamber, 25: stroke adjustment screw, 26: selector valve, 27: air supply tube, 28: exhaust tube, 29: control line, 30: sealing member, 31: discharge unit, 32: liquid chamber, 33: connection member, 34: sealing member, 35: valve seat, 36: communication hole, 37: supply path, 38: extended-out portion, 39: reservoir, 40: adaptor tube, 41: nozzle fixture, 42: discharge device (air type), 43: vacuum mechanism, 44: block-like member, 45: through-hole, 46: support portion, 47: vent hole, 48: coupling, 49: liquid amount detection mechanism, 50: block-like member, 51: through-hole, 52: support portion, 53: sensor, 54: sensor hole, 55: connection line, 56: nozzle (prior art), 57: discharge tube (prior art), 58: chamfered surface, 59: body (prior art), 60: driver main body, 61: discharge main body

The invention claimed is:

1. A nozzle for discharging a liquid material, the nozzle comprising a body having a liquid inflow space, and a discharge tube communicating with the liquid inflow space and extending downwards from the body, wherein a liquid removing member is disposed at a lower end of the body in a state laterally surrounding the discharge tube, the liquid removing member includes a plurality of surrounding surfaces that surround a lateral surface of the discharge tube, and a groove that is formed adjacent to the plurality of surrounding surfaces, and that generates capillary force acting in a direction laterally away from the discharge tube and holds the liquid material removed from outer surfaces of the discharge tube, the groove is constituted by a pair of guide surfaces that are disposed in an opposing relation and a flat outer surface of the body which is orthogonal to the pair of guide surfaces and formed to extend perpendicular to a body axis passing a center of the discharge tube, a distance between the pair of guide surfaces being larger than an outer diameter of the discharge tube, the discharge tube is cylindrical and has an annular flat distal end surface, and the surrounding surfaces generate capillary force acting on the liquid, which climbs along the lateral surface of the discharge tube, in a direction towards a base of the discharge tube in cooperation with the lateral surface of the discharge tube.

2. The nozzle for discharging the liquid material according to claim 1, wherein the distance between the pair of guide surfaces is not more than 3 times the outer diameter of the discharge tube.

3. The nozzle for discharging the liquid material according to claim 2, wherein the nozzle includes two grooves that are disposed to lie on one straight line with the discharge tube positioned at a middle therebetween.

4. The nozzle for discharging the liquid material according to claim 2, wherein a length of the discharge tube is larger than a height of each of the plurality of surrounding surfaces and the guide surfaces.

5. A liquid material discharge device of air type comprising:

the nozzle for discharging the liquid material according to claim 4;

a syringe storing the liquid material and having a distal end to which the nozzle for discharging the liquid material is fitted, and an air supply tube through which pressurized gas is supplied to the syringe, wherein the length of the discharge tube is 1.2 to 1.5 times the height of the liquid removing member.

6. The nozzle for discharging the liquid material according to claim 1, wherein a distance between each of the plurality of surrounding surfaces and the lateral surface of the discharge tube is 1 to 3 times the outer diameter of the discharge tube.

7. The nozzle for discharging the liquid material according to claim 6, wherein a length of the discharge tube is several times an inner diameter of the discharge tube, and the capillary force acting in the direction towards the base of the discharge tube is generated until the liquid climbing along the lateral surface of the discharge tube reaches the base of the discharge tube.

8. The nozzle for discharging the liquid material according to claim 7, wherein the distance between the pair of guide surfaces and the distance between each of the plurality of surrounding surfaces and the lateral surface of the discharge tube are each 2000 μm or less.

9. The nozzle for discharging the liquid material according to claim 6, wherein the distance between the pair of guide surfaces and the distance between each of the plurality of surrounding surfaces and the lateral surface of the discharge tube are each 2000 μm or less.

10. The nozzle for discharging the liquid material according to claim 1, wherein a space defined by the plurality of surrounding surfaces and surrounding the lateral surface of the discharge tube is a cylindrical space.

11. The nozzle for discharging the liquid material according to claim 1, wherein the groove is constituted as a plurality of grooves.

12. The nozzle for discharging the liquid material according to claim 11, wherein the plurality of grooves spaces are arranged in a state radially extending from the discharge tube at evenly distributed intervals therebetween.

13. The nozzle for discharging the liquid material according to claim 1, wherein a length of the discharge tube is larger than a height of each of the plurality of surrounding surfaces and the guide surfaces.

14. A liquid material discharge device of air type comprising:

the nozzle for discharging the liquid material according to claim 13;

a syringe storing the liquid material and having a distal end to which the nozzle for discharging the liquid material is fitted, and an air supply tube through which pressurized gas is supplied to the syringe, wherein the length of the discharge tube is 1.2 to 1.5 times the height of the liquid removing member.

15. A liquid material discharge device comprising the nozzle for discharging the liquid material according to claim 1, and a plunger for applying inertial force to the liquid material.

16. The liquid material discharge device according to claim 15, further comprising a vacuum mechanism and a suction device, wherein the vacuum mechanism includes a block-like member provided with a through-hole having an inner side opening positioned near the liquid removing member, and an outer side opening of the through-hole in the block-like member is connected to the suction device.

17. The liquid material discharge device according to claim 16, further comprising a liquid amount detection mechanism and a liquid amount detection device, wherein the liquid amount detection mechanism includes a sensor inserted in a through-hole of the block-like member, the sensor being connected to the liquid amount detection device.

18. The liquid material discharge device according to claim 15, further comprising a liquid amount detection mechanism and a liquid amount detection device, wherein the liquid amount detection mechanism includes a block-like member that surrounds the nozzle for discharging the liquid material, a sensor hole formed in the block-like member and having an opening positioned near the liquid removing member, and a sensor inserted in the sensor hole, the sensor being connected to the liquid amount detection device.

* * * * *